US010680391B2

(12) United States Patent
I

(10) Patent No.: US 10,680,391 B2
(45) Date of Patent: Jun. 9, 2020

(54) HEAT DESTRUCTIVE DISCONNECTING SWITCH

(71) Applicant: GREEN IDEA TECH INC., Mahe (SC)

(72) Inventor: Hsiang-Yun I, Tainan (TW)

(73) Assignee: Green Idea Tech Inc., Mahe (SC)

( * ) Notice: Subject to any disclaimer, the term of this patent is extended or adjusted under 35 U.S.C. 154(b) by 0 days.

(21) Appl. No.: 16/215,614

(22) Filed: Dec. 10, 2018

(65) Prior Publication Data

US 2020/0014156 A1 Jan. 9, 2020

(30) Foreign Application Priority Data

Jul. 3, 2018 (TW) ..... 107123010 A

(51) Int. Cl.

| | |
|---|---|
| ***H01H 3/02*** | (2006.01) |
| ***H01H 3/54*** | (2006.01) |
| ***H01R 13/713*** | (2006.01) |
| ***H01H 3/12*** | (2006.01) |
| ***H01H 3/38*** | (2006.01) |
| *H01R 25/00* | (2006.01) |
| *H01H 1/22* | (2006.01) |

(52) U.S. Cl.

CPC ..... *H01R 13/7137* (2013.01); *H01H 3/022* (2013.01); *H01H 3/12* (2013.01); *H01H 3/38* (2013.01); *H01H 3/54* (2013.01); *H01H 1/22* (2013.01); *H01H 2221/068* (2013.01); *H01R 25/003* (2013.01)

(58) Field of Classification Search

CPC ..... H01H 37/00; H01H 37/20; H01H 37/32; H01H 37/76; H01H 37/764; H01H 73/02; H01H 2037/762; H01H 85/36

See application file for complete search history.

(56) References Cited

U.S. PATENT DOCUMENTS

| | | | | |
|---|---|---|---|---|
| 9,698,542 | B1 | 7/2017 | I | |
| 10,403,459 | B1 * | 9/2019 | I | H01R 13/7137 |
| 10,438,762 | B1 * | 10/2019 | I | H01H 13/20 |

FOREIGN PATENT DOCUMENTS

| | | |
|---|---|---|
| CN | 103441019 B | 10/2015 |
| TW | 321352 | 11/1997 |

(Continued)

*Primary Examiner* — Vanessa Girardi

(74) *Attorney, Agent, or Firm* — Michael D. Eisenberg

(57) ABSTRACT

A heat destructive disconnecting switch, comprises a first conductive member, a second conductive member, a movable conductive member, an overheating destructive member, an operating component, and a second elastic member. The movable conductive member conducts electricity to the first conductive member and the second conductive member. A first elastic member and the second elastic member act on an operating member. The first elastic member is compressed and provided with a first elastic force, and the second elastic member is provided with a second elastic force. When the overheating destructive member is destructed due to overheating, the first elastic force is diminished or vanishes, causing the second elastic force to be larger than the first elastic force. Consequently, the movable conductive member disconnects the current conducting state between the first conductive member and the second conductive member, thereby achieving a protective effect from overheating.

10 Claims, 11 Drawing Sheets

(56) References Cited

FOREIGN PATENT DOCUMENTS

| | | |
|---|---|---|
| TW | 560690 | 11/2003 |
| TW | 250403 | 11/2004 |
| TW | 382568 | 6/2010 |

* cited by examiner

HEAT DESTRUCTIVE DISCONNECTING SWITCH

CROSS REFERENCES TO RELATED APPLICATIONS

The present application claims priority from Taiwanese Patent Application Serial Number 107123010, filed Jul. 3, 2018, the disclosure of which is hereby incorporated by reference herein in its entirety.

BACKGROUND OF THE INVENTION

(a) Field of the Invention

The present invention relates to a heat destructive disconnecting switch, and more particularly to a power-off structure that is distinct from a fuse and different from a bimetallic strip. An overheating destructive member of the present invention does not depend on the passing of current to enforce destruction thereof, but uses heat energy transfer to enforce destruction and cause the switch to cut off power.

(b) Description of the Prior Art

Seesaw switches of the prior art use a control switch to effect back and forth pivot rotation within a specified angle range to control closing or opening a circuit. For example, the prior art structure of a "Spark shielding structure of switch" disclosed in ROC Patent No. 560690 describes a positioning feature when pivot rotating a switch to position the switch at a first position or a second position to form a closed circuit or an open circuit.

As for press switches of the prior art, pressing the press switch enables cycling through controlling the closing or opening of a circuit, wherein the press button uses the reciprocating press-button structure similar to that used in an automatic ball-point pen of the prior art, whereby the press button is positioned at a lower position or an upper position each time the switch press button is pressed, an example of which is described in the prior art structure of a "Push-button switch" disclosed in China Patent No. CN103441019.

In the prior art structure of an "Improved structure of an on-line switch" described in ROC Patent No. 321352, a switch structure is disclosed that is provided with a fuse; however, the fuse is positioned in the path of the power supply live wire, and thus necessarily depends on electric current passing there through in order to bring about a protective effect. In particular, only when the power supply is overloaded will the fuse melt and cut off the supply of power. In as much the fuse requires a current to pass through during operation, however, the current must be excessive in order to melt the fuse, hence, a low-melting-pointlead-tin allow or zinc, that have a electric conductivity far lower than that of copper, is often used for the fuse. Taking an extension cord socket as an example, which mainly uses copper as a conductive body, if the extension cord socket is combined with the switch disclosed in the above-described ROC Patent No. 321352 to control the power supply, then conductivity of the fuse is poor, easily resulting in power-wasting problems.

In the prior art structure of a "Bipolar type auto power off safety switch" described in ROC Patent No. M382568, a bimetallic strip type overload protection switch is disclosed; however, the bimetallic strip must similarly be positioned in the path of the electric current, and thus necessarily depends on electric current passing therethrough for deformation of the bimetallic strip to occur. More particularly, an overloaded electric current is necessary in order to cause the bimetallic strip to deform and break the circuit.

In the prior art structure of an "Overload protection switch structure for group type socket" described in ROC Patent No. M250403, an overload protection switch applied in an extension cord socket is disclosed, wherein the patented overload protection switch is fitted with a bimetallic strip. When the total power of the entire extension cord socket exceeds the rated power, the bimetallic strip under goes heat deformation and automatically trips, thereby achieving a power-off protective effect. However, the bimetallic strip necessarily depends on electric current passing there through in order to bring about an overload protective effect. Moreover, electric conductivity of the bimetallic strip is far lower than that of copper, which, thus, easily results in power-wasting problems.

Nevertheless, apart from current overload causing overheating, taking an extension cord socket as an example, the following situations are all possible scenarios resulting in overheating of any one of the sockets, including:

1. Serious oxidation of the metal pins of the plug, wherein the metal pins have become coated with oxides; thus, when the plug is inserted into a socket, the oxides, having poor conductivity, cause greater electrical resistance, which results in the socket overheating.

2. When inserting the metal pins of a plug into a socket, and the metal pins are not completely inserted, resulting in only partial contact, then the contact areas are too small, which causes the socket to overheat.

3. Metal pins of the plug are deformed or worn out, resulting in incomplete contact when inserted into a socket and the contact areas being too small, which gives rise to the socket overheating.

4. Metal pins of the plug or metal strips of the socket are stained with foreign substances, such as dust or dirt, causing poor electric conductivity, which results in greater electrical resistance and overheating.

The above-described conditions result in a critical drop in the operating temperature in the locality of the socket and the operating temperature in the locality of the overload protection switch.

The inventor of the present invention in an "Assembly and method of plural conductive slots sharing an overheating destructive fixing element" described in U.S. Patent application No. US9698542 disclosed to distance of a copper strip and temperature difference experimentation, and from the test results presented in TABLE 2 of the above patent, it can be seen that if the above-described overheated socket is positioned attest position 10 of TABLE 2, and the above-described overload protection switch is positioned attest position 1 of TABLE 2, with a distance of 9 cm between the two positions, then when the socket operating temperature reaches 202.9° C., after 25 minutes, the operating temperature of the overload protection switch is only 110.7° C.; that is, when the distance between the socket and the overload protection switch is 9 cm, and when the operating temperature of the socket has already overheated to a temperature of 202.9° C. with the possibility of accidental combustion, the bimetallic strip of the overload protection switch is still only at a temperature of 110.7° C., and has not yet reached deformation temperature; thus, the overload protection switch will not automatically trip a power-off.

Because there are many circumstances resulting in socket overheating, and the distance between the socket and the bimetallic strip of the overload protection switch can result in an enormous temperature difference, in order to effectively achieve overheating protection, an overload protection switch bimetallic strip should be installed on each of the plug sockets of the extension cord socket. However, the price of a bimetallic strip type overload protection switch is relatively high, thus installing a bimetallic strip on each of the sockets of an extension cord socket will lead to a substantial increase in cost and go against it being available to all.

SUMMARY OF THE INVENTION

Based on the above-described shortcomings, the present invention provides a heat destructive disconnecting switch, comprising: A base, which is provided with a holding space; a first conductive member, which penetrates and is mounted on the base; a second conductive member, which penetrates and is mounted on the base; a movable conductive member, which is mounted within the holding space and electrically connected to the first conductive member, and selectively connects with the second conductive member; an overheating destructive member, which is destructed under a fail temperature condition, the fail temperature lying between 100° C. to 250° C.; and an operating component, which is assembled on the base, and comprises an operating member and a first elastic member. The operating member comprises a contact member and a limiting member. The overheating destructive member butts against the contact member. The first elastic member is compressed and confined between the contact member and the limiting member, and is provided with a first elastic force. The heat destructive disconnecting switch further comprises a second elastic member, which is provided with a second elastic force that acts on the operating member.

When the operating member is at a first position, the first elastic force presses and forces the movable conductive member to contact the second conductive member to form a power-on state. When in a power-on state, an electric current passes through the first conductive member, the movable conductive member, and the second conductive member which thus producing heat energy. The overheating destructive member absorbs the heat energy and is destructed under the fail temperature condition as described above, resulting in lessening or loss of the first elastic force. At which time, the second elastic force is larger than the first elastic force; therefore, the second elastic force presses and forces the operating member to displace to a second position, causing the movable conductive member to separate from the second conductive member to form a power-off state.

Further, the first elastic member and the second elastic member are both springs.

Further, the arrangement of the first conductive member and the second conductive member is defined as being in a lengthwise direction. The operating member is provided with a length in the lengthwise direction, and the first elastic member is disposed at the central position of the length. There is a distance between the disposed position of the second elastic member on the length and the central position.

Further, the movable conductive member is a conductive seesaw member, which a strides and is mounted on the first conductive member. The contact member slides on the conductive seesaw member, thereby enabling the conductive seesaw member to selectively contact or separate from the second conductive member in a seesaw movement. Furthermore, the operating member is provided with a pivot connecting point that is pivot connected to the base, thus enabling the operating member to use the pivot connecting point as an axis and limit back and forth rotation, which causes the contact member to slide on the conductive seesaw member. Furthermore, the limiting member is provided with a hollow retaining space, which is provided with an opening, and the first elastic member is inserted within the retaining space. The contact member partially penetrates into the retaining space and also partially extends out the opening, Furthermore, the contact member is a hollow shaped heat conducting member, which comprises an open end and a curved contact end. The contact end contacts the movable conductive member, which is disposed within the heat conducting member through the open end.

Furthermore, the overheating destructive member is provided with a destructive portion and two protruding portions, which are located on corresponding surfaces of the destructive portion. One of the protruding portions extends into the first elastic member, restraining the first elastic member on the destructive portion and enabling the destructive portion to contact the heat conducting member; or the overheating destructive member comprises a supporting member, a rod portion, and a head portion. The supporting member is mounted on the rod portion and contacts the heat conducting member. The rod portion extends into the first elastic member, which causes the first elastic member to butt against the supporting member and the head portion to butt against the heat conducting member.

Further, the movable conductive member is a conductive cantilever member, which is a spring plate; and a first conductive member, the spring plate, and the conductive cantilever member are formed as an integral body. Furthermore, a base is provided with a protruding portion, and an operating member is mounted on the protruding portion, wherein the operating member has limited up and down displacement on the protruding portion, Furthermore, an overheating destructive member is fixed on the movable conductive member, which is further provided with a mounting hole. The overheating destructive member is fixed in the mounting hole, and the minimum diameter of the mounting hole is larger than the maximum width of the contact member. Furthermore, the overheating destructive member is provided with a through hole, and the peripheral edge of the overheating destructive member is provided with a rib. The overheating destructive member penetrates and extends through the mounting hole, closely fitting the inner edge of the mounting hole, thereby restraining the rib on the peripheral edge of the mounting hole of the movable conductive member. Furthermore, the contact member is provided with a supporting base and two limiting posts, which are located on corresponding surfaces of the supporting base. One of the limiting posts extends into the first elastic member, and the other limiting post extends into the through hole of the overheating destructive member.

The above-described overheating destructive member can be a circular disk, a cylindrical body, a cap, a block, a spherical body, an irregular shaped body, or a radial shaped disk.

The present invention also provides a plug socket provided with a switch, comprising the above-described heat destructive disconnecting switch, a live wire insert piece, a live wire conductive member, a neutral wire conductive member, and a casing, wherein the casing comprises a live wire socket and a neutral wire socket. The live wire insert piece is electrically connected to the second conductive member. The live wire insert piece further comprises a live wire slot that corresponds to the live wire socket. The live wire conductive member comprises a live wire connecting end that is electrically connected to the first conductive member, and the neutral wire conductive member comprises a neutral wire slot that corresponds to the neutral wire socket.

Furthermore, there are a plurality of the above-described heat destructive disconnecting switches, a plurality of the above-described live wire sockets, and a plurality of the above-described live wire insert pieces, wherein each of the live wire insert pieces are independently electrically connected to each of the above-described second conductive members. The live wire conductive member comprises a plurality of the live wire connecting ends, each of which is electrically connected to each of the above-described first conductive members. Furthermore, there are a plurality of the above-described neutral wire sockets, and a plurality of the above-described neutral wire slots, all of which are series connected to the neutral wire conductive members.

Based on the above-described technological characteristics, the present invention is able to achieve the following effects:

1. The overheating destructive member is not positioned in the path of the electric current, and is not responsible for transmitting current. Hence, when the present invention is used in an electric appliance or an extension cord socket, electric conductivity of the overheating destructive member is far lower than that of copper, and will not directly influence electric effectiveness of the electric appliance or the extension cord socket.

2. The entire structure is simple, easily manufactured, and will not markedly increase the size of the switch. Moreover, manufacturing cost is relatively low, and is easily embodied in known seesaw switches, press switches, or other switches.

3. Because of its small size and low cost, the heat destructive disconnecting switch is suitable for application in extension cord switches. For example, installing each of the plug sockets of the extension cord with a heat destructive disconnecting switch ensures the safety of each set of socket apertures corresponding to each of the switches when in use, and also redresses the high cost of conventional bimetallic strips, and the shortcoming thereof whereby a plurality of sets of socket apertures are required to jointly use one overload protection switch, which will not protect socket apertures distanced further away from the overload protection switch that are already overheating, resulting in an increase in temperature thereof, but the overload protection switch has still not tripped because the temperature has not yet reached the trip temperature.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Based on the above-described technological characteristics, the major effects of a heat destructive disconnecting switch and a plug socket provided therewith of the present invention are clearly presented in the following embodiments.

Figure 1:
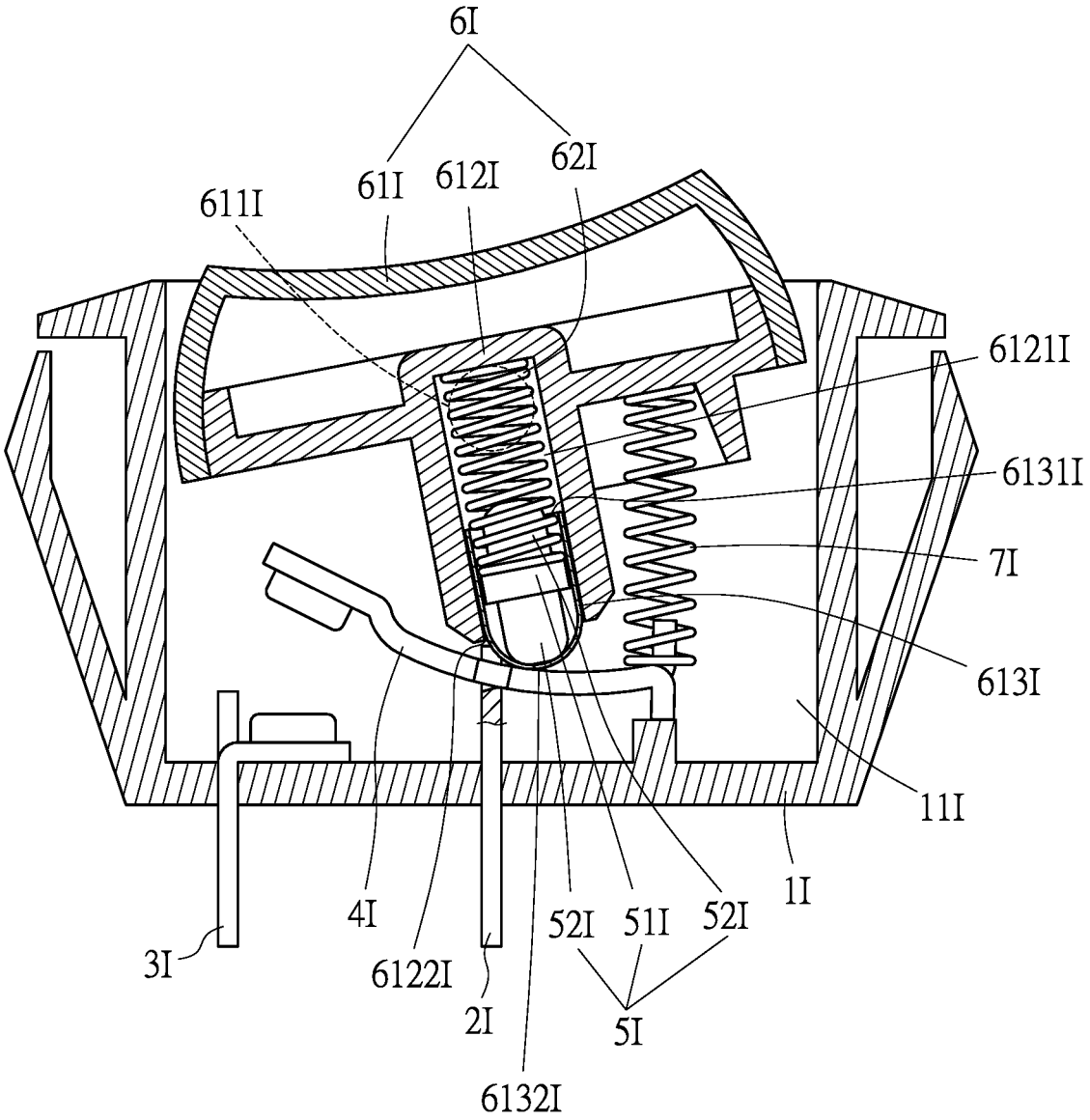
FIG. 1 is a schematic view of a first embodiment of the present invention, and shows a seesaw switch structure with the seesaw switch in a closed position.

Referring to FIG. 1, which shows a first embodiment of the present invention, wherein the heat destructive disconnecting switch of the present embodiment is a seesaw switch, and FIG. 1 depicts the seesaw switch in a closed state.

The seesaw switch comprises:

A base (1I), which is provided with a holding space (11I); a first conductive member (2I) and a second conductive member (3I), both of which penetrate and are mounted on the base (1I); a movable conductive member, which is mounted within the holding space (11I), wherein the movable conductive member is a conductive seesaw member (4I) that a strides and is mounted on the first conductive member (2I) and electrically connected to the first conductive member (2I); and an overheating destructive member (5I), which is destructed under a fail temperature condition, the fail temperature lying between 100° C. to 250° C. The overheating destructive member (5I) is not used to maintain the continued supply of electric current; therefore, insulating material such as plastic, or non-insulating material made from a low-melting alloy, or low-melting metals can be used. The aforementioned low-melting alloys include an alloy of bismuth and any one of or a composition from a plurality of the metals cadmium, indium, silver, tin, lead, antimony, or copper, among which a tin-bismuth alloy has a melting point around 138° C. In the present embodiment, the overheating destructive member (5I) comprises a destructive portion (51I) and two protruding portions (52I), which are located on corresponding surfaces of the destructive portion (51I).

However, the overheating destructive member (5I) can also be a circular disk, a cylindrical body, a cap, a block, a spherical body, an irregular shaped body, or a radial shaped to disk.

When there is a temperature anomaly in the operating temperature, resulting in a rise in temperature, it is preferred that a live wire triggers a circuit break. Therefore, the first conductive member (2I) in use is a live wire first end, the second conductive member (3I) in use is a live wire second end, and the conductive seesaw member (4I) is used to enable electrical conduction with the first conductive member (2I) and the second conductive member (3I) to form a live wire closed circuit.

The seesaw switch of the present embodiment is further provided with an operating component (6I), which is used to operate the conductive seesaw member (4I) to connect with the first conductive member (2I) and the second conductive member (3I) to form a live wire closed circuit, or disconnect the circuit between the first conductive member (2I) and the second conductive member (3I), causing the live wire to form an open circuit. The operating component (6I) is assembled on the base (1I) and comprises an operating member (61I) and a first elastic member (62I), wherein a press surface of the operating member (61I) is a nonconductor. The operating member (61I) is provided with a pivot connecting point (611I), which is pivot connected to the base (1I), thereby enabling the operating member (61I) to use the pivot connecting point (611I) as an axis and limit back and forth rotation, The operating member (61I) further comprises a contact member and a limiting member (612I), wherein the contact member is a hollow shaped heat conducting member (613I), which comprises an open end (6131I) and a curved contact end (6132I). The contact end (6132I) of the heat conducting member (613I) contacts the conductive seesaw member (4I), and the limiting member (612I) is provided with a hollow retaining space (6121I), which is provided with an opening (6122I). The first elastic member (62I) is inserted within the retaining space (6121I), and the heat conducting member (613I) partially penetrates into the opening (6122I). The overheating destructive member (5I) is disposed within the heat conducting member (613I) through the open end (6131I), causing one of the protruding portions (52I) to but against the heat conducting member (613I), and enabling the destructive portion (51I) to contact the heat conducting member (613I). The other protruding portion (52I) extends into the first elastic member (62I), causing one end of the first elastic member (62I) to butt against the internal surface of the limiting member (612I), and the other end to butt against the destructive portion (51I) of the overheating destructive member (5I). As a result, the first elastic member (62I) is compressed and provided with a first elastic force.

The seesaw switch of the present embodiment is further provided with a second elastic member (7I), which, in the present embodiment, is a spring. The second elastic member (7I) is provided with a second elastic force that acts on the operating member (61I).

Figure 2:
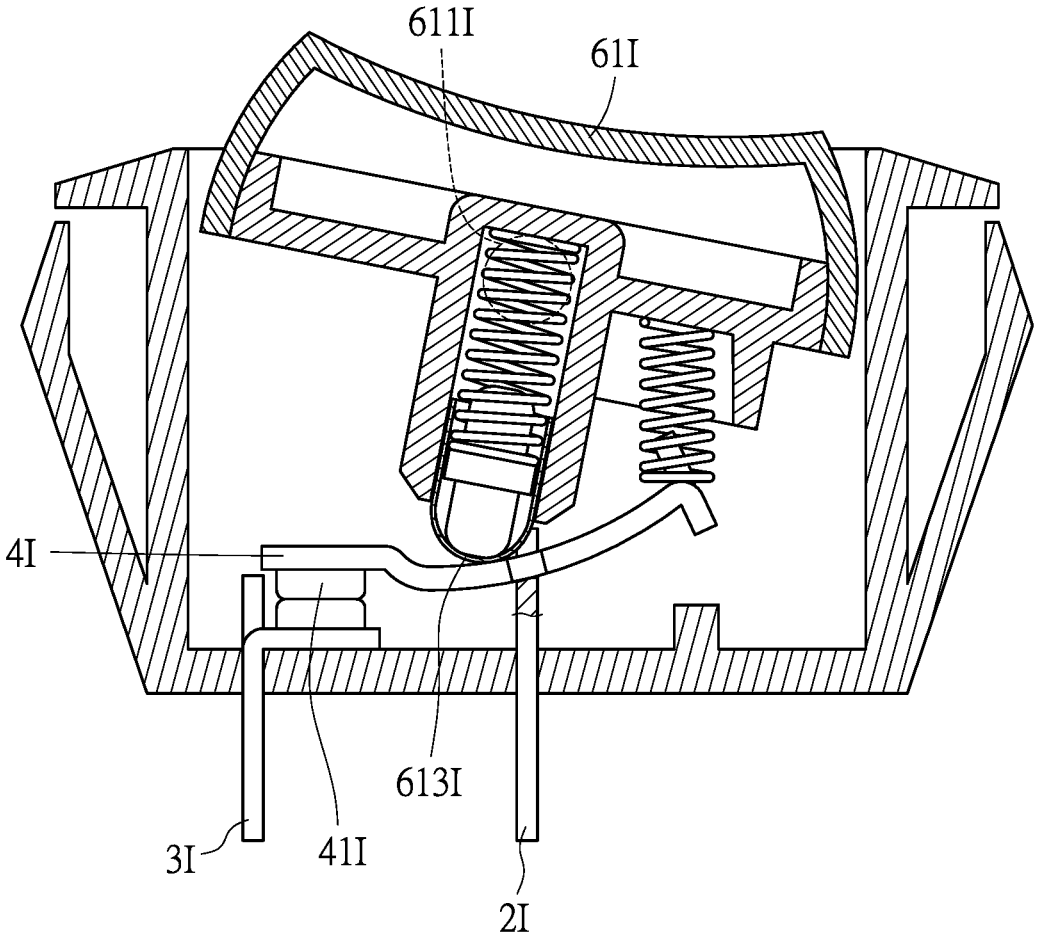
FIG. 2 is a schematic view of the first embodiment of the present invention, and shows the seesaw switch in an open position.

Referring to FIG. 2, a user toggles the operating member (61I) back and forth around the pivot connecting point (611I), causing the heat conducting member (613I) to slide on the conductive seesaw member (4I), which propels the conductive seesaw member (4I) to selectively contact or separate from the second conductive member (3I) in a seesaw movement. When the heat conducting member (613I) is slid on the conductive seesaw member (4I) in the direction of a silver contact point (41I) on the conductive seesaw member (4I), the first elastic force forces the silver contact point (41I) to contact the second conductive member (3I) and form a power-on state.

Figure 3:
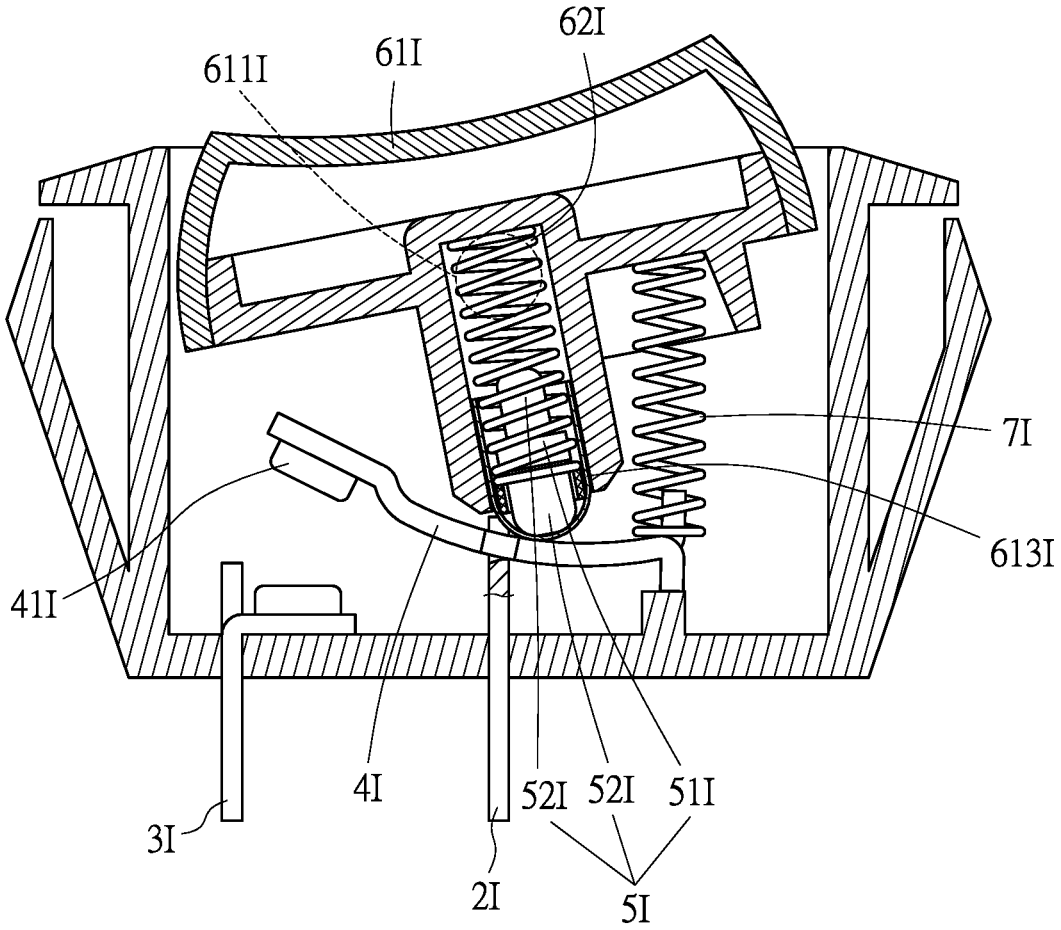
FIG. 3 is a schematic view of the first embodiment of the present invention, and shows, when an overheating destructive member is destructed due to overheating, a movable conductive member disconnected from a second conductive member, causing the seesaw switch to revert to a closed position from an open position.

Referring to FIG. 3, when an abnormal condition occurs in an external electric equipment connected to the first conductive member (2I) or the second conductive member (3I), for example, the external electric equipment is a plug socket, oxides or dust present between the metal pins of a plug and the plug socket, or phenomena such as incomplete insertion of the metal pins or distorted metal pins will cause a relatively large heat energy in the electrical conducting portions of the plug socket, whereupon, the first conductive member (2I) or the second conductive member (3I) transfers the heat energy to the conductive seesaw member (4I), and then through the heat conducting member (613I) to the destructive portion (51I) of the overheating destructive member (51I). The destructive portion (51I) gradually absorbs the heat energy up to a point prior to the melting point thereof, at which time the destructive portion (51I) gradually loses its rigidity. For example, if the material of the overheating destructive member (5I) is a tin-bismuth alloy, although the melting point thereof is 138° C., the tin-bismuth alloy begins to lose its rigidity when the temperature is close to its melting point, and under the concurrent effect of the first elastic force, the first elastic member (62I) compresses and deforms the destructive portion (51I) of the overheating destructive member (5I) to the extent of destructing the destructive portion (51I), resulting in lessening or loss of the first elastic force, at which time the second elastic force is larger than the first elastic force. In the present embodiment, the arrangement of the first conductive member (2I) and the second conductive member (3I) is defined as being in a lengthwise direction. The operating member (61I) has a length in the lengthwise direction, and the first elastic member (62I) is disposed at the central position of the length. There is a distance between the disposed position of the second elastic member (7I) and the central position. Hence, when the second elastic force is larger than the first elastic force, a torque effect forces the operating member (61I) to rotate on the pivot connecting point (611I) as an axis, which causes the heat conducting member (613I) to slide on the conductive seesaw member (4I) and forces the operating member (61I) to displace and form a closed position. Consequently, the silver contact point (41I) of the conductive seesaw member (4I) separates from the second conductive member (3I) to form a power-off state, thereby achieving the protective effect against overheating.

Figure 4:
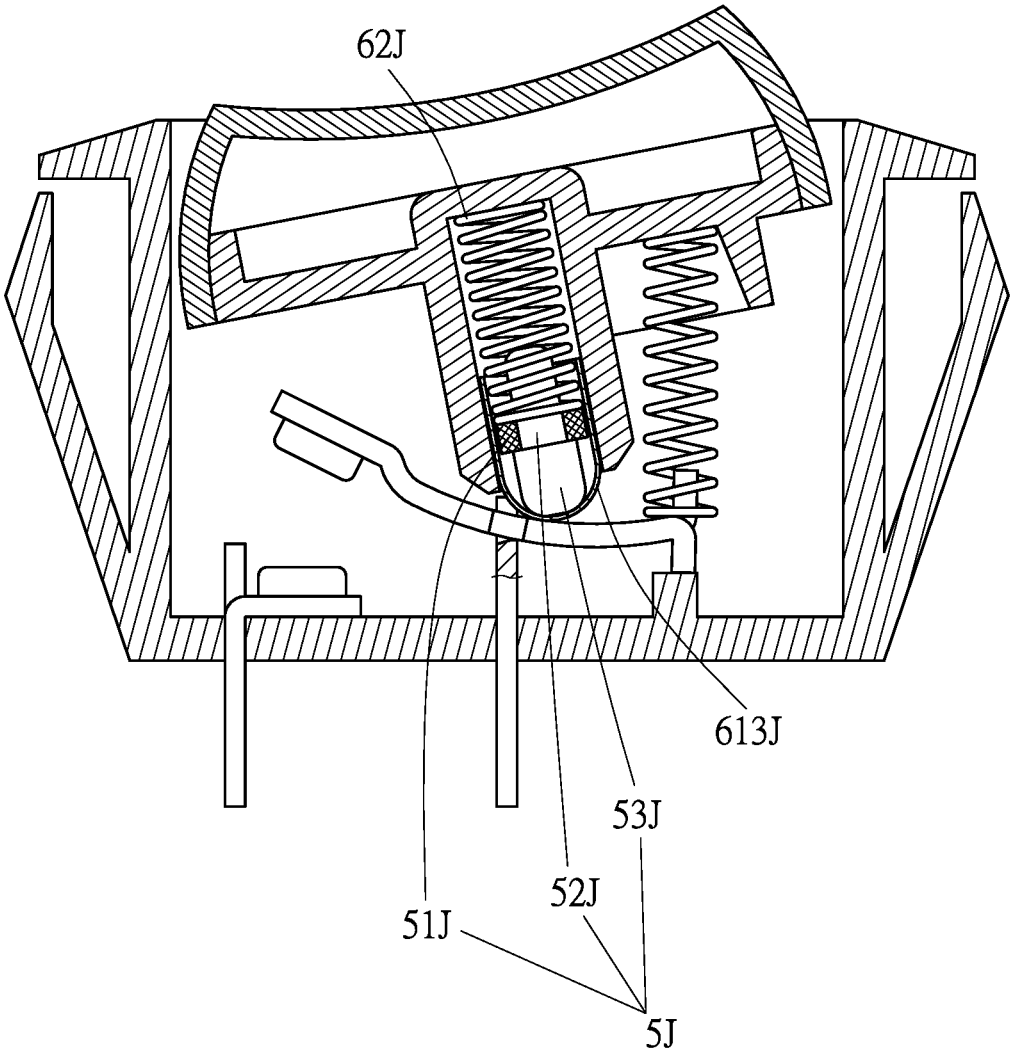
FIG. 4 is a schematic view of a second embodiment of the present invention, and shows another seesaw switch structure with the seesaw switch in a closed position.

Referring to FIG. 4, which shows a second embodiment of the present invention, wherein the heat destructive disconnecting switch of the present embodiment is a seesaw switch, and FIG. 4 depicts the seesaw switch in a closed state. The present embodiment is almost the same as the first embodiment, the only differences being in:

The present embodiment is provided with an overheating destructive member (5J), a first elastic member (62J), and a contact member which is a heat conducting member (613J), The overheating destructive member (5J) comprises a supporting member (51J) with a rod portion (52J) and a head portion (53J) connected thereto. The supporting member (51J) is mounted on the rod portion (52J) and contacts the heat conducting member (613J). The width of the head portion (53J) is larger than the width of the rod portion (52J), which penetrates the supporting member (51J) and extends into the first elastic member (62J), thereby causing the supporting member (51J) to butt against the head portion (53J), The head portion (53J) additionally butts against the heat conducting member (613J), and the first elastic member (62J) butts atop the supporting member (51J).

Figure 5:
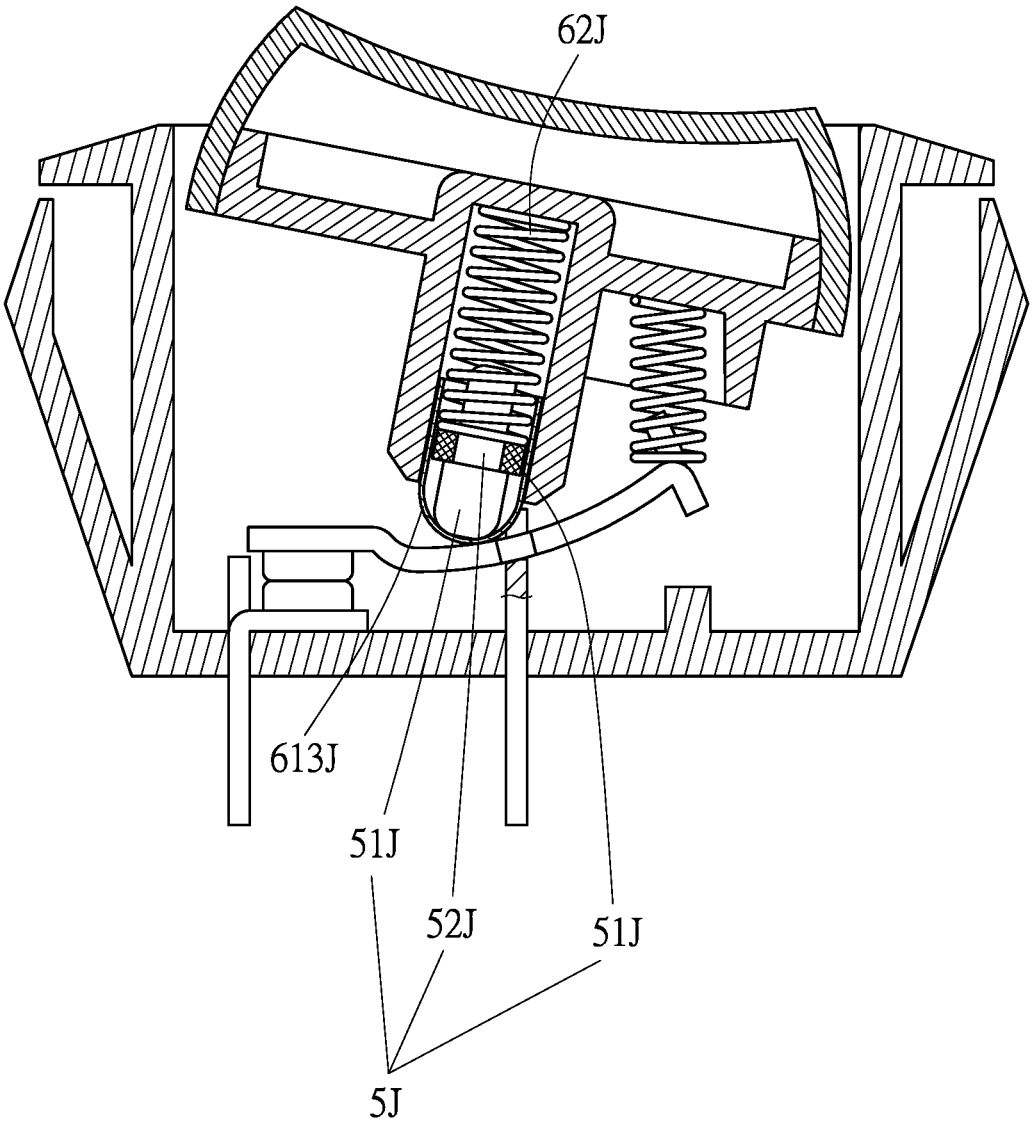
FIG. 5 is a schematic view of the second embodiment of the present invention, and shows the seesaw switch in an open position.

Referring to FIG. 5, which shows a live wire conducting state of the present embodiment identical to that of the first embodiment, and thus not further detailed herein.

Figure 6:
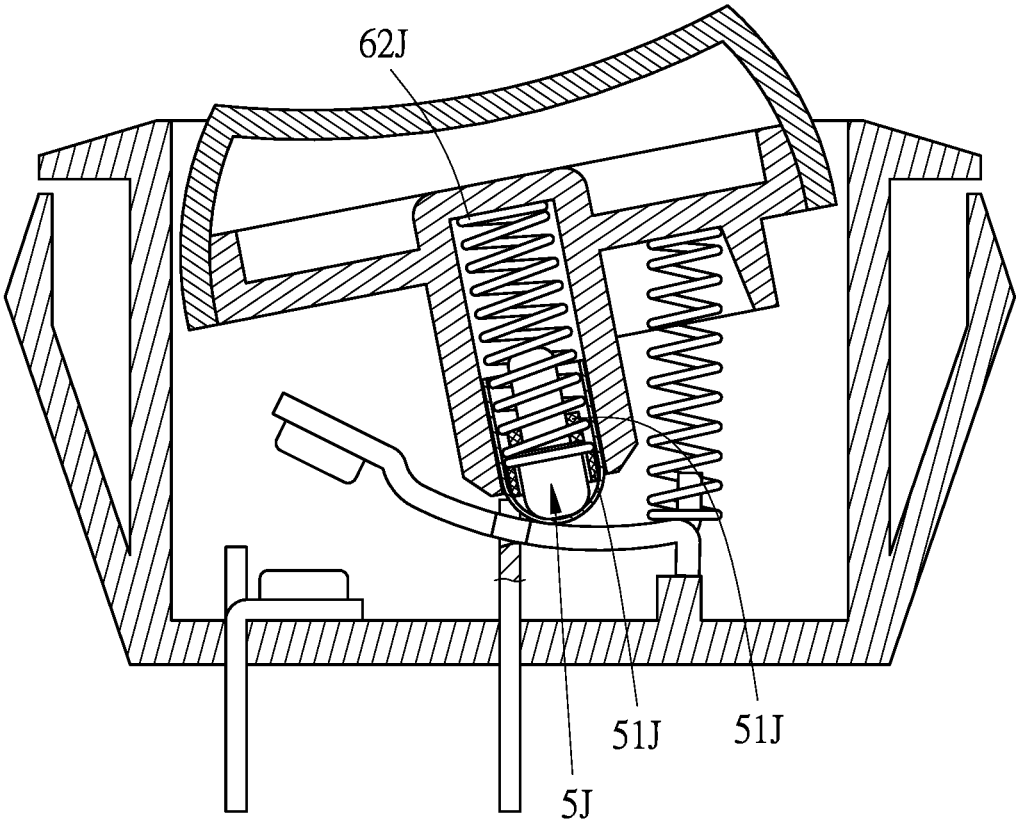
FIG. 6 is a schematic view of the second embodiment of the present invention, and shows, when an overheating destructive member is destructed due to overheating, a movable conductive member disconnected from a second conductive member, causing the seesaw switch to revert to a closed position from an open position.

Referring to FIG. 6, wherein the supporting member (51J) of the overheating destructive member (5J) of the present embodiment, due to live wire overheating and under the concurrent effect of the first elastic force, is compressed and deformed by the first elastic member (62J) to the extent of the first elastic member (62J) breaking through the supporting member (51J), resulting in lessening or loss of the first elastic force. At which time the second elastic force is larger than the first elastic force, which causes a power-off state to form similar status to the first embodiment.

Figure 7:
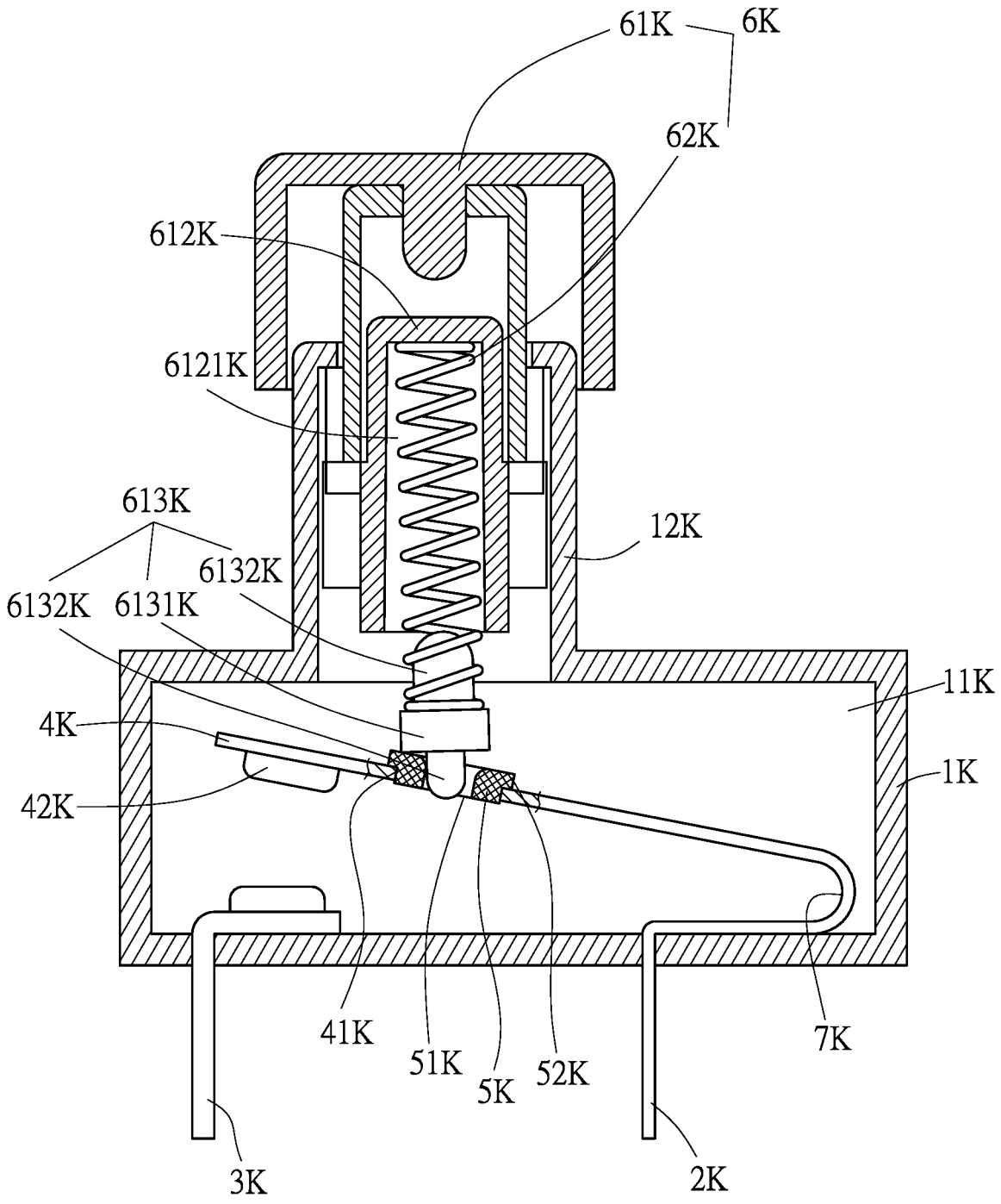
FIG. 7 is a schematic view of a third embodiment of the present invention, and shows a press switch structure with the press switch in a closed position.

Referring to FIG. 7, which shows a third embodiment of the present invention, wherein the heat destructive disconnecting switch of the present embodiment is a press switch, and FIG. 7 shows the press switch in a closed state.

The press switch comprises:

A base (1K), which is provided with a holding space (11K) and a protruding portion (12K); a first conductive member (2K) and a second conductive member (3K), both of which penetrate and are mounted on the base (1K); a movable conductive member, which is mounted within the holding space (11K), wherein the movable conductive member is a conductive cantilever member (4K); and an overheating destructive member (5K), which is destructed under a fail temperature condition, the fail temperature lying between 100° C. to 250° C. The overheating destructive member (5K) is not used to maintain the continued supply of electric current, thus, insulating material such as plastic or non-insulating material made from a low-melting alloy or low-melting metals, wherein a low-melting alloy such as an alloy of bismuth and any one of or a composition from a plurality of cadmium, indium, silver, tin, lead, antimony, or copper can be used; an example of which is a tin-bismuth alloy with a melting point around 138° C. In the present embodiment, the conductive cantilever member (4K) is provided with a mounting hole (41K). The overheating destructive member (5K) assumes an annular shape and is provided with a through hole (51K). In addition, a rib (52K) extends from the peripheral edge of the overheating destructive member (5K), which is mounted in the mounting hole (41K), thereby restraining the rib (52K) on the peripheral edge of the mounting hole (41K).

If a circuit becomes overheated, it is preferred that a live wire triggers a circuit break. Therefore, the first conductive member (2K) in use is a live wire first end, the second conductive member (3K) in use is a live wire second end, and the conductive cantilever member (4K) is used to conduct current to the first conductive member (2K) and the second conductive member (3K) to form a live wire closed circuit.

The press switch of the present embodiment is further provided with an operating component (6K), which is used to operate the conductive cantilever member (4K) to connect with the first conductive member (2K) and the second conductive member (3K) to form a live wire closed circuit, or disconnect the circuit between the first conductive member (2K) and the second conductive member (3K), causing the live wire to form an open circuit. The operating component (6K) is assembled on the base (1K), and comprises an operating member (61K) and a first elastic member (62K), wherein a press surface of the operating member (61K) is a nonconductor. The operating member (61K) is mounted on the protruding portion (12K), and has limited up and down displacement thereon. The up and down displacement and positioning structure of the entire operating component (6K) is the same as the press button structure of an automatic ball-point pen of the prior art, such as the prior art structure of a "Push-button Switch" disclosed in China Patent No. CN103441019; therefore, the drawings of the present embodiment omit illustrating a number of structural positions disclosed in the prior art. The operating member (61K) comprises a limiting member (612K) and a contact member (613K), wherein the limiting member (612K) is provided with a hollow retaining space (6121K). The contact member (613K) is provided with a supporting base (6131K) and two limiting posts (6132K), which are located on corresponding surfaces of the supporting base (6131K), wherein one of the limiting posts (6132K) extends into the through hole (51K) of the overheating destructive member (5K). The first elastic member (62K) is inserted within the retaining space (6121K), and the other limiting post (6132K) of the contact member (613K) extends into the first elastic member (62K). The first elastic member (62K) is compressed and confined between the overheating destructive member (5K) and the limiting member (612K), which provides the first elastic member (62K) with a first elastic force.

The press switch of the present embodiment is further provided with a second elastic member, which is a spring plate (7K). The first conductive member (2K), the spring plate (7K), and the conductive cantilever member (4K) are formed as an integral body. The spring plate (7K) is provided with a second elastic force that acts on the operating member (61K).

Figure 8:
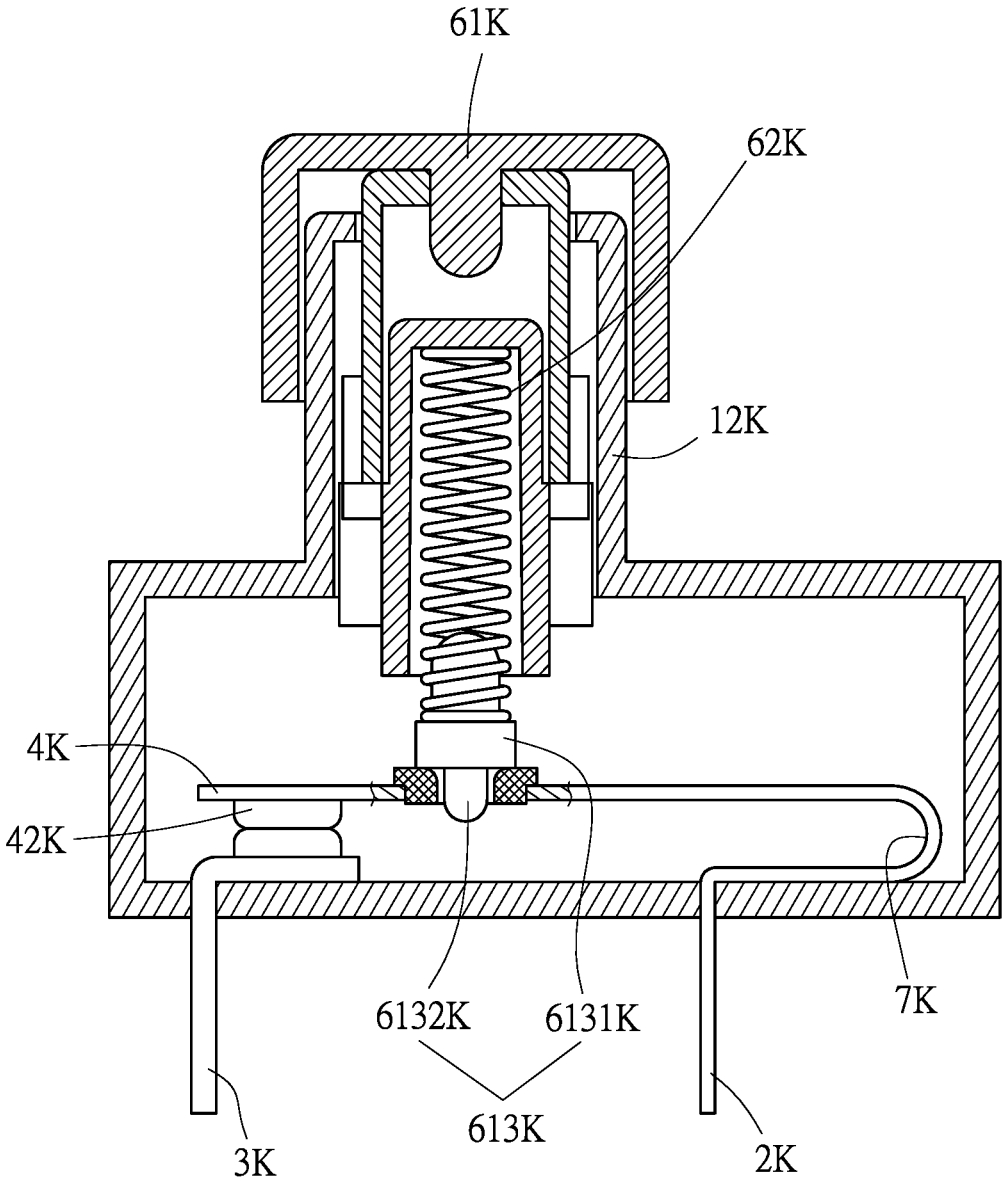
FIG. 8 is schematic view of the third embodiment of the present invention, and shows the press switch in an open position.

Referring to FIG. 8, a user displaces the operating member (61K) relative to the protruding portion (12K), just like pressing the button on an automatic ball-point pen, which causes the conductive cantilever member (4K) to selectively contact or separate from the second conductive member (3K). When the operating member (61K) is displaced in the direction of the conductive cantilever member (4K) and positioned, the supporting base (6131K) of the contact member (613K) presses a silver contact point (42K) of the conductive cantilever member (4K), which causes the conductive cantilever member (4K) to contact the second conductive member (3K) and form a power-on state. At the same time, the first elastic member (62K) is further compressed, enlarging the first elastic force thereof, at which time the first elastic force is larger than the second elastic force.

Figure 9:
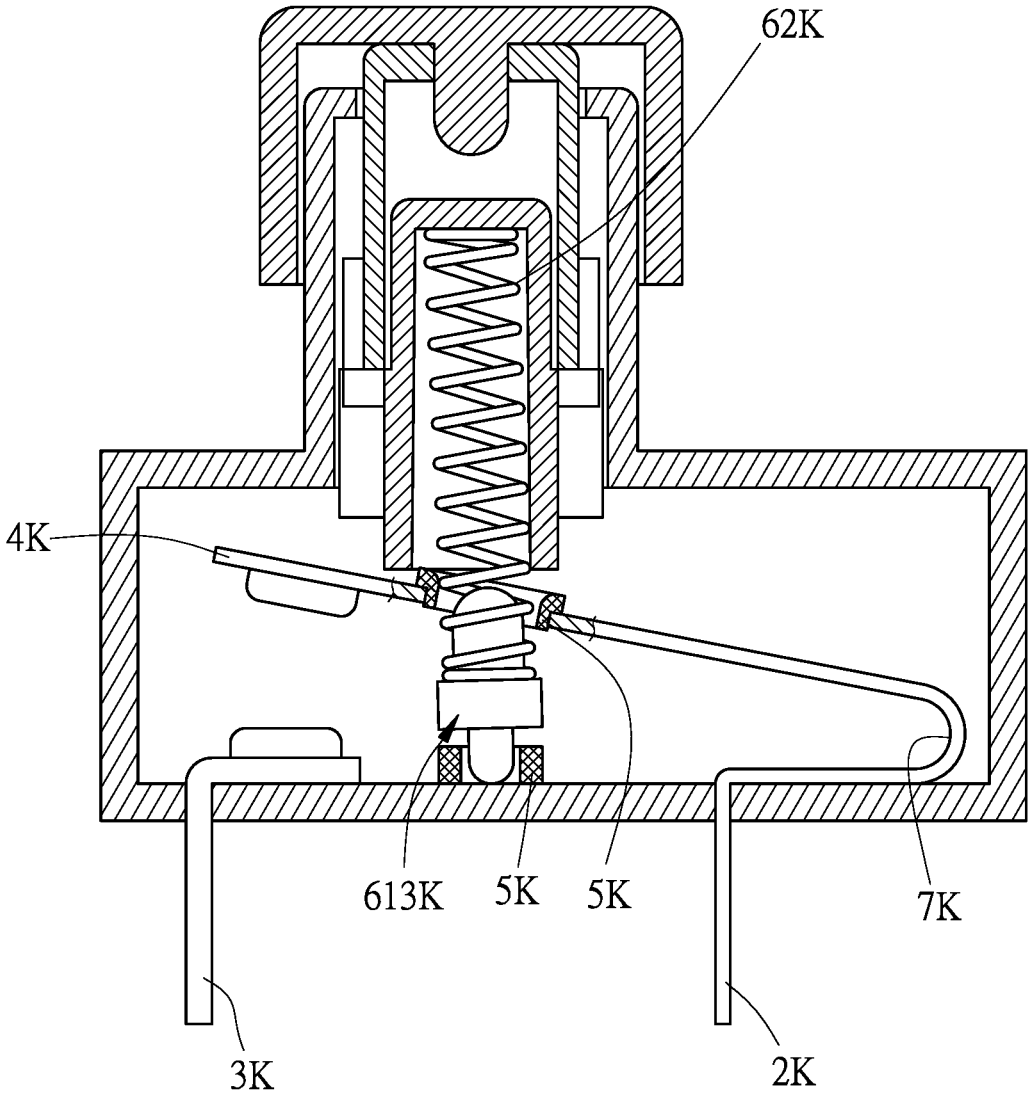
FIG. 9 is a schematic view of the third embodiment of the present invention, and shows, when an overheating destructive member is destructed due to overheating, a movable conductive member disconnected from a second conductive member to form an open circuit.

Referring to FIG. 9, when an abnormal condition occurs in an external electric equipment connected to the first conductive member (2K) or the second conductive member (3K), for example, the external electric equipment is a plug socket, oxides or dust present between the metal pins of a plug and the plug socket, or phenomena such as incomplete insertion of the metal pins or distorted metal pins will produce relatively large amounts of heat energy in the electrical conducting portions of the plug socket, whereupon, the heat energy is transferred to the conductive cantilever member (4K) through the first conductive member (2K) or the second conductive member (3K), and then transferred to the overheating destructive member (5K). The overheating destructive member (5K) gradually absorbs the heat energy up to a point prior to the melting point thereof, at which time the overheating destructive member (5K) gradually loses its rigidity. For example, if the material of the overheating destructive member (5K) is a tin-bismuth alloy, although the melting point thereof is 138° C., the tin-bismuth alloy begins to lose its rigidity when the temperature is close to its melting to point, and under the concurrent effect of the first elastic force, the first elastic member (62K) presses the contact member (613K), which then presses the overheating destructive member (5K), which becomes deformed under the pressure to the extent of being destructed, and is no longer able to restrain the first elastic member (62K). FIG. 9 shows the overheating destructive member (5K) already destructed, wherein a destructed portion of the overheating destructive member (5K) has separated from its original position and caused the first elastic member (62K) to elongate, resulting in lessening or loss of the first elastic force. At which time, the second elastic force is larger than the first elastic force, forcing the conductive cantilever member (4K) to restore its original position, causing the silver contact point (41K) of the conductive cantilever member (4K) to separate from the second conductive member (3K) and form a power-off state, thereby achieving the protective effect against overheating.

Figure 10:
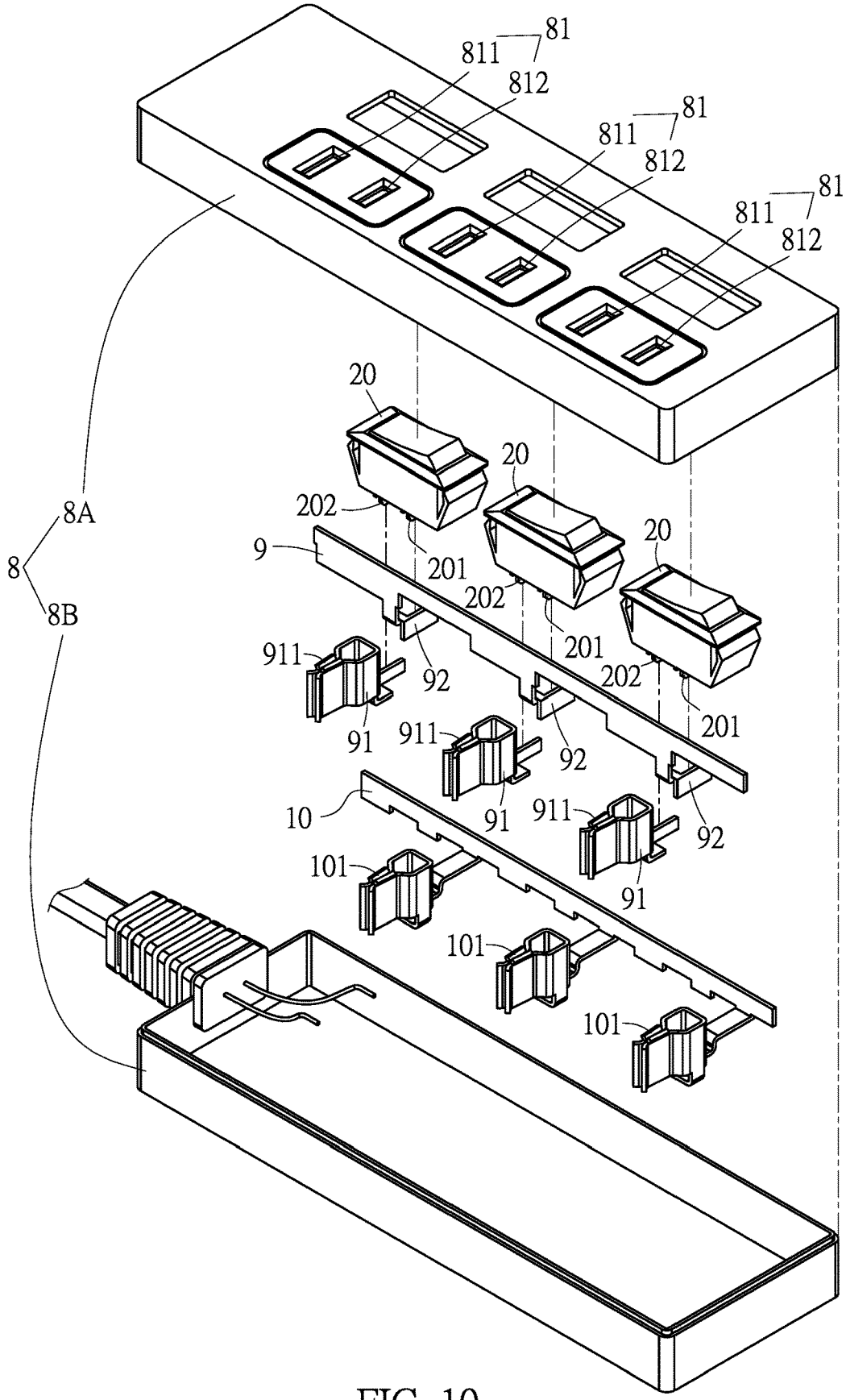
FIG. 10 is an exploded view of a heat destructive disconnecting switch of the present invention used in an extension cord socket.
Figure 11:
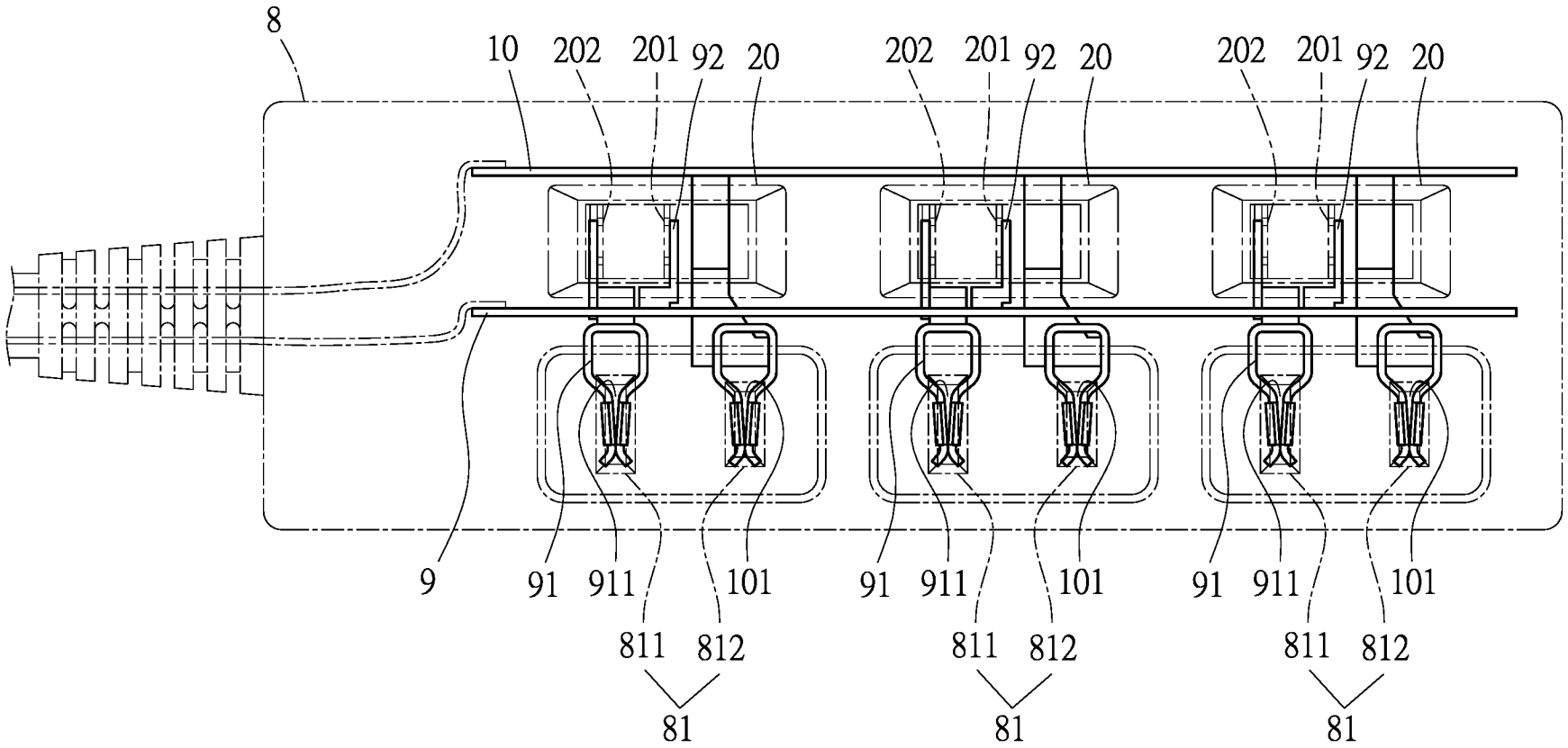
FIG. 11 is a structural view of the heat destructive disconnecting switch of the present invention used in an extension cord socket.

Referring to FIG. 10 and FIG. 11, which show another embodiment of the present invention, wherein the present embodiment applies the heat destructive disconnecting see-saw switch of the above-described embodiment in an extension cord socket comprising three sets of socket apertures (8I). The extension cord socket comprises:

A casing (8), provided with an upper casing (8A) and a lower casing (8B), wherein the upper casing (8A) comprises the three socket apertures (8I), and each of the socket apertures (8I) comprises a live wire socket (81I) and a neutral wire socket (812); a live wire conductive member (9), which is installed in the casing (8), wherein the live wire conductive member (9) is provided with three spaced live wire connecting ends (92); three live wire insert pieces (9I), wherein each of the live wire insert pieces (9I) comprises a live wire slot (91I), and the live wire slots (91I) correspond to the live wire sockets (81I); a neutral wire conductive member (10), which is installed in the casing (8), wherein the neutral wire conductive member (10) is provided with three spaced neutral wire slots (10I), each of the neutral wire slots (10I) corresponds to the respective neutral wire socket (812); three heat destructive disconnecting switches (20), which are as described above in the first embodiment to the fourth embodiment, wherein a first conductive member (20I) of each of the heat destructive disconnecting switches (20) is connected to the respective live wire connecting end (92) of the live wire conductive member (9), and a second conductive member (202) is connected to the live wire insert piece (9I); or the first conductive member (20I) of each of the heat destructive disconnecting switches (20) is connected to the live wire insert piece (9I), and the second conductive member (202) is connected to the live wire connecting end (92) of the live wire conductive member (9). In the present embodiment the first conductive members (20I) are respectively connected to the live wire connecting ends (92) of the live wire conductive member (9). Taking the second conductive members (202) respectively connected to the live wire insert pieces (9I) as an example (the characteristics of the connecting method for this portion has already been described in the first embodiment to the third embodiment, and thus not further detailed herein). Accordingly, when there is a temperature anomaly in the operating temperature of any one of the live wire insert pieces (9I) of the extension cord socket resulting in a rise in temperature thereof, the heat energy is transferred to the heat destructive disconnecting switch (20) associated therewith through the first conductive member (20I) or the second conductive member (202), whereupon overheating causes the heat destructive disconnecting switch (20) to break the circuit due to overheating, thereby cutting off the supply of power. At which time, the live wire insert piece (9I) with an abnormal temperature immediately cuts off the supply of power, stopping the operating temperature from continuing to rise and enabling the operating temperature to slowly fall. Because each of the heat destructive disconnecting switches (20) independently controls a set of the live wire socket (81I) and neutral wire socket (812), when any one of the heat destructive disconnecting switches (20) breaks the circuit due overheating, the other sets of the live wire socket (81I) and neutral wire socket (812) can still continue to operate as normal.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A heat destructive disconnecting switch, comprising:

a base, which is provided with a holding space;

a first conductive member, which penetrates and is mounted on the base;

a second conductive member, which penetrates and is mounted on the base;

a movable conductive member, which is mounted within the holding space and electrically connected to the first conductive member, and selectively connects with the second conductive member;

an overheating destructive member, which is destructed under a fail temperature condition, the fail temperature lying between 100° C. to 250° C.;

an operating component, which is assembled on the base, and the operating component comprises an operating member and a first elastic member, wherein the operating member comprises a contact member and a limiting member, the overheating destructive member butts against the contact member, the first elastic member is compressed and confined between the contact member and the limiting member, and is provided with a first elastic force;

a second elastic member, which is provided with a second elastic force that acts on the operating member;

whereby when the operating member is at a first position, the first elastic force presses and forces the movable conductive member to contact the second conductive member and form a power-on state; when in a power-on state, an electric current passes through the first conductive member, the movable conductive member, and the second conductive member producing heat energy, whereupon, the overheating destructive member absorbs the heat energy and is destructed under the fail temperature condition, resulting in lessening or loss of the first elastic force, at which time the second elastic force is larger than the first elastic force, and the second elastic force presses and forces the operating member to displace to a second position, thereby causing the movable conductive member to separate from the second conductive member and form a power-off state.

2. The heat destructive disconnecting switch according to claim 1, wherein the first elastic member and the second elastic member are both springs.

3. The heat destructive disconnecting switch according to claim 1, wherein arrangement of the first conductive member and the second conductive member is defined as being in a lengthwise direction, the operating member is provided with a length in the lengthwise direction, the first elastic member is disposed at central position of the length, and there is a distance between the disposed position of the second elastic member on the length and the central position.

4. The heat destructive disconnecting switch according to claim 1, wherein the movable conductive member is a conductive seesaw member, which astrides and is mounted on the first conductive member, and the contact member slides on the conductive seesaw member, thereby enabling the conductive seesaw member to selectively contact or separate from the second conductive member in a seesaw movement.

5. The heat destructive disconnecting switch according to claim 1, wherein the operating member is provided with a pivot connecting point that is pivot connected to the base, the operating member uses the pivot connecting point as an axis, which limits back and forth rotation and enables the contact member to slide on the conductive seesaw member.

6. The heat destructive disconnecting switch according to claim 1, wherein the limiting member is provided with a hollow retaining space, the retaining space is provided with an opening, the first elastic member is inserted within the retaining space, and the contact member partially penetrates into the retaining space and also partially extends out the opening.

7. The heat destructive disconnecting switch according to claim 1, wherein the overheating destructive member is a circular disk, a cylindrical body, a cap, a block, a spherical body, an irregular shaped body, or a radial shaped disk.

8. The heat destructive disconnecting switch according to claim 1, wherein the contact member is a hollow shaped heat conducting member, which comprises an open end and a curved contact end, the contact end contacts the movable conductive member, and the overheating destructive member is disposed within the heat conducting member through the open end.

9. The heat destructive disconnecting switch according to claim 8, wherein the overheating destructive member is provided with a destructive portion and two protruding portions, the two protruding portions are located on corresponding surfaces of the destructive portion; one of the protruding portions extends into the first elastic member, restraining the first elastic member on the destructive portion and enabling the destructive portion to contact the heat conducting member.

10. The heat destructive disconnecting switch according to claim 8, wherein the overheating destructive member comprises a supporting member, a rod portion, and a head portion; the supporting member is mounted on the rod portion and contacts the heat conducting member, the rod portion extends into the first elastic member, which causes the first elastic member to butt against the supporting member and the head portion to butt against the heat conducting member.

* * * * *